US005770919A

United States Patent [19]

Tjaden et al.

[11] Patent Number: 5,770,919

[45] Date of Patent: Jun. 23, 1998

[54] FIELD EMISSION DEVICE MICROPOINT WITH CURRENT-LIMITING RESISTIVE STRUCTURE AND METHOD FOR MAKING SAME

[75] Inventors: Kevin Tjaden; David A. Cathey, Jr., both of Boise; John K. Lee, Meridian, all of Id.

[73] Assignee: Micron Technology, Inc., Boise, Id.

[21] Appl. No.: 775,843

[22] Filed: Dec. 31, 1996

[51] Int. Cl.[6] ..... H01J 1/30

[52] U.S. Cl. ..... 313/495; 313/309; 313/336; 313/351; 313/496

[58] Field of Search ..... 313/309, 336, 313/351, 495, 496, 497

[56] References Cited

U.S. PATENT DOCUMENTS

| | | | |
|---|---|---|---|
| 3,665,241 | 5/1972 | Spindt et al. . | |
| 3,671,798 | 6/1972 | Lees . | |
| 3,755,704 | 8/1973 | Spindt et al. . | |
| 3,789,471 | 2/1974 | Spindt et al. . | |
| 3,812,559 | 5/1974 | Spindt et al. . | |
| 3,970,887 | 7/1976 | Smith et al. . | |
| 4,940,916 | 7/1990 | Borel et al. . | |
| 5,162,704 | 11/1992 | Kobori et al. . | |
| 5,210,472 | 5/1993 | Casper et al. . | |
| 5,372,973 | 12/1994 | Doan et al. . | |
| 5,374,868 | 12/1994 | Tjaden et al. . | |
| 5,427,280 | 6/1995 | Jones et al. | 313/336 |
| 5,451,830 | 9/1995 | Huang | 313/336 |
| 5,569,975 | 10/1996 | Taylor et al. | 313/336 |
| 5,585,301 | 12/1996 | Lee et al. . | |
| 5,666,020 | 9/1997 | Takemura | 313/495 |

*Primary Examiner*—Nimeshkumar Patel
*Attorney, Agent, or Firm*—Hale and Dorr LLP

[57] ABSTRACT

A micropoint assembly of a field emission device ("FED") including a baseplate, one or more conductors formed over the baseplate, and one or more micropoints formed over the conductor(s) is disclosed. The micropoint assembly further includes resistive structures associated with specific FED elements that limit current to a maximum level and minimize impact to remaining elements of the device. Any variation in resistivity is uniformly distributed since the same process is consistently applied across a plurality of element locations.

10 Claims, 5 Drawing Sheets

FIELD EMISSION DEVICE MICROPOINT WITH CURRENT-LIMITING RESISTIVE STRUCTURE AND METHOD FOR MAKING SAME

FIELD OF THE INVENTION

This invention relates to field emission devices (FEDs) and, more particularly, to FED micropoints with current limiting resistive structures.

BACKGROUND OF THE INVENTION

FED technology has recently come into favor as a technology for developing low power, flat panel displays. This technology uses an array of cold cathode emitters and cathodoluminescent phosphors for conversion of energy from an electron beam into visible light. Part of the desire to use FED technology for flatpanel displays is that such technology is conducive to producing flat screen displays having high performance, low power and light weight.

Referring to FIG. 1, a representative cross-section of a prior art FED 100 is shown generally. As is well known, FED technology operates on the principal of cathodoluminescent phosphors being exited by cold cathode field emission electrons. The general structure of FED 100 includes semiconductor layer, or baseplate 102 and a relatively thin conductive layer formed over the baseplate 102. Baseplate 102, and/or the thin conductive layer formed over baseplate 102 and the other structures to be discussed below may be considered as part of a substrate, where the term substrate, as used herein, refers to one or more semiconductor layers or structures that may include active or operable portions of semiconductor devices.

The thin conductive structure may be formed from doped polycrystalline silicon or metal that is deposited on baseplate 102 in a conventional manner. This thin conductive structure serves as the emitter electrode. The thin conductive structure is usually deposited on baseplate 102 in strips that are electrically connected. In FIG. 1, a cross-section of strips 104, 106, and 108 is shown. The number of strips for a particular device will depend on the size and desired operation of the FED.

At predetermined sites on the respective emitter electrode strips, spaced apart patterns of micropoints are formed. In FIG. 1, micropoint 110 is shown on strip 104, micropoints 112, 114, 116, and 118 are shown on strip 106, and micropoint 120 is shown on strip 108. With regard to the patterns of micropoints on strip 106, a square pattern of 16 micropoints, which includes micropoints 112, 114, 116, and 118, may be positioned at that location. However, it is understood that one or a pattern of more than one micropoint may be located at any one site. For purposes of discussion, the combination of one or more micropoints disposed over a conductive layer or region which, in turn, resides over or in a substrate is referred to as a micropoint assembly. For example, FIG. 1 identifies micropoint assembly 119.

Preferably, each micropoint resembles a cone. The forming and sharpening of each micropoint is carried out in a known manner such as disclosed in U.S. Pat. Nos. 3,970,887 and 5,372,973, both of which are hereby incorporated by reference in their entirety for all purposes. The micropoints may be constructed of a number of materials, such as single crystal silicon. Moreover, to ensure the optimal performance of the micropoints, the tips of the micropoints can be coated or treated with a low work function material.

After forming the micropoints, dielectric insulating layer 122 is deposited over emitter electrode strips 104, 106, and 108, and the patterned micropoints located at predetermined sites on the strips. The insulating layer may be made from silicon dioxide ($SiO_2$).

A conductive layer is disposed over insulation layer 122. This conductive layer forms extraction structure 132. The extraction structure 132 is a low potential anode that is used to extract electrons from the micropoints. Extraction structure 132 may be made from a variety of materials including chromium, molybdenum, doped polysilicon or silicided polysilicon. Extraction structure 132 may be formed as a continuous layer or as parallel strips. If parallel strips form extraction structure 132, it is referred to as an extraction grid, and the strips are disposed perpendicular to emitter electrode strips 104, 106 and 108 thereby forming the rows of the matrix structure. Whether a continuous layer or strips are used, once either is positioned on the insulating layer, they are appropriately etched by conventional methods to surround but be spaced away from the micropoints.

At each intersection of the extraction and emitter electrode strips or at desired locations along emitter electrode steps when a continuous extraction structure is used, a micropoint or pattern of micropoints are disposed on the emitter strip. Each micropoint or pattern of micropoints are meant to illuminate one pixel of the screen display.

Once the lower portion of the FED is formed according to either of the methods described above, faceplate 140 is fixed a predetermined distance above the top surface of the extraction structure 132. Typically, this distance is several hundred micrometers. This distance may be maintained by spacers or other conventional methods. Representative spacers 136 and 138 are shown in FIG. 1.

Faceplate 140 is a cathodoluminescent screen that is constructed from dear glass or other suitable material. A conductive material, such as indium tin oxide ("ITO") is disposed on the surface of the glass facing the extraction structure. ITO layer 142 serves as the anode of the FED. A high vacuum is maintained in area 134 between faceplate 140 and baseplate 102.

Black matrix 149 is disposed on this surface of the ITO layer 142 facing extraction structure 132. Black matrix 149 defines the discreet pixel areas for the screen display of the FED. Phosphor material is disposed on ITO layer 142 in the appropriate areas defined by black matrix 149. Representative phosphor material areas that define pixels are shown at 144, 146 and 148. These pixels are aligned with the openings in extraction structure 132 so that a micropoint or group of micropoints that are meant to excite phosphor material are aligned with that pixel. Zinc oxide is an example of a suitable material for the phosphor material since it can be excited by low energy electrons.

A FED has one or more voltage sources that maintain emitter electrode strips 104, 106 and 108, extraction structure 132, and ITO layer 142 at three different potentials for proper operation of the FED. Emitter electrode strips 104, 106 and 108 are at "−" potential, extraction structure is at a "+" potential, and the ITO layer 142 at a "++" potential. When such an electrical relationship is used, extraction structure 132 will pull an electron emission stream from micropoints 110, 112, 114, 116, 118 and 120. Thereafter, ITO layer 142 will attract the freed electrons.

The electron emission streams that emanate from the tips of the micropoints fan out conically from their respective tips. The majority of the electrons strike the phosphors at 90° to the faceplate while the remainder strike it at various acute angles. The contrast and brightness of the screen display of the FED are optimized when the emitted electrons strike or impinge upon the phosphors at 90°.

In devices such as FED 100, it is difficult to control current through the micropoints (e.g., 110–120). Nonuniform current can create brightness nonuniformity in the display and excessive currents can cause failure in the FED. When a FED is first turned on, local degasification occurs which can produce electric arcs between components, such as micropoint 118 and extraction structure 132. Additionally, because the components in the FED are small, manufacturing defects can cause a micropoint to be electrically shorted to structure 132. These problems can cause enough current to be drawn through one of the micropoints to destroy it and other surrounding micropoints, thus resulting in damage or even destruction of the FED.

U.S. Pat. No. 4,940,916 discloses a FED having a continuous resistive layer disposed along the length of each of a number of conductive strips in the cathode. This layer limits current flowing through each conductive strip. With this approach, current for many individual micropoints passes through the same underlying resistive layer. This layer significantly impacts the layout and/or physical dimensions of other FED elements since it is continuously disposed between a conductive layer and corresponding micropoints. Specifically, its inclusion requires modification and/or displacement of the underlying conductive layer and/or an overlying dielectric insulating layer. Further, using a continuous resistive layer rather than an individual resistor dedicated to each micropoint, may result in unequal amounts of current flowing from adjacent micropoints to the same pixel rather than having all micropoints dedicated to the same pixel each provide an equal amount of current to the pixel.

In contrast, U.S. Pat. No. 3,789,471 discloses a micropoint electron source in which each micropoint rests atop a pedestal made from an electrically resistive material. However, each pedestal (disposed directly on top of a planar conductive layer) requires a separate and different deposition step from the micropoint and therefore complicates FED fabrication. Specifically, the pedestal is formed by deposition of emitter material that is passed through a mask having a uniform dedicated aperture. Conversely, the associated micropoint is formed by deposition of emitter material through a modified dedicated mask such that the aperture gradually reduces in size during deposition.

In addition to complicating FED fabrication, micropoint-dedicated apertures introduce micropoint-specific variables into this process (e.g., aperture size). Accordingly, the dimensions of the resulting structure (e.g., height) will vary independently from point-to-point dependent upon, for example, aperture size. Such variation will create equally independent fluctuations in resistivity. As a result, control of resistive value must be maintained at the individual micropoint level to compensate for any lack of uniformity introduced by micropoint-specific variables.

U.S. Pat. No. 3,812,559 disdoses pyramid-like micropoints that may be made from resistive, insulating or composite materials. These structures are fabricated using the same process as described above in U.S. Pat. No. 3,789,471 and, therefore, are subject to the same limitations.

Accordingly, it is desirable to provide an improved micropoint architecture that includes resistive structures created through conventional processing techniques and applied uniformly to select, multiple FED elements (such as micropoints and conductors) with minimum impact to remaining FED elements.

SUMMARY OF THE INVENTION

Micropoints with resistive (i.e., current-limiting) structures and methods for making the same are disclosed. Micropoint assemblies constructed according to the principles of the invention include resistive structures created using easily controlled and conventional semiconductor fabrication processes such as in situ doping, ion implantation and etching. Resistors are specifically and separately associated with affected FED elements (e.g., micropoints and/or conductors) to minimize the impact to remaining FED elements. Variations in resistivity are uniformly distributed since the same doped layer or ion implantation is applied consistently across a plurality of element locations.

In accordance with one embodiment of the present invention, a method for forming a micropoint assembly comprises the steps of forming a first layer over a baseplate, the first layer having a first resistance value and being disposed over a first location for a first micropoint and a second location for a second micropoint; forming a second layer over the first layer, the second layer having a second resistance value that is greater than the first resistance value and being disposed over the first and second locations; and removing (e.g., etching) selected portions of the first and second layers to form the first and second micropoints.

In accordance with another embodiment of the present invention, a micropoint assembly includes a substrate, a conductive layer formed in the substrate and a plurality of micropoints disposed over the conductive layer, each of the micropoints being formed in the substrate and including a first layer having a first resistance value and a second layer having a second resistance value that is greater than the first resistance value.

In a further embodiment, a field emission display has a baseplate, a plurality of micropoint regions formed on the baseplate, a plurality of conductors coupled to the micropoint regions, and a plurality of resistors, each resistor disposed within one of the conductors. Each resistor is designed to prevent current through the region from exceeding a maximum level.

The present invention provides methods for limiting current with resistive structures that uses conventional techniques, minimizes impact to existing FED architecture and provides for uniform application. Other features and advantages will be apparent from the following detailed description, drawings and claims.

DETAILED DESCRIPTION

Figure 2:
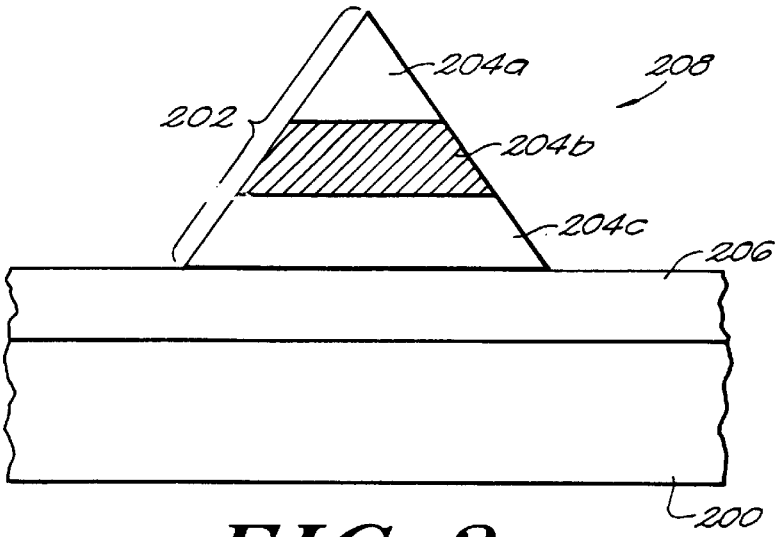
FIG. 2 is a cross-sectional view of a micropoint assembly according to a first embodiment of the present invention.

FIG. 2 is a cross-sectional view of a micropoint assembly 208 according to a first embodiment of the present invention. Assembly 208 (forming a portion of a FED), has a semiconductor layer or baseplate 200, a conductor 206 over baseplate 200, and one or more micropoints 202 formed on conductor 206. Each micropoint 202 has its own resistive layer that prevents the current through that micropoint from exceeding a maximum level. As shown here, micropoint 202 has three layers, a low resistance top layer 204*a,* a low resistance bottom layer 204*c,* and a high resistance middle layer 204*b* that provides sufficient resistance so that the current flowing through the micropoint is limited to a safe level. This resistance thus prevents destruction of the micropoint and of surrounding micropoints that could otherwise be damaged by high current. A process for fabricating micropoint assembly 208 is provided in FIG. 3.

Figure 3:
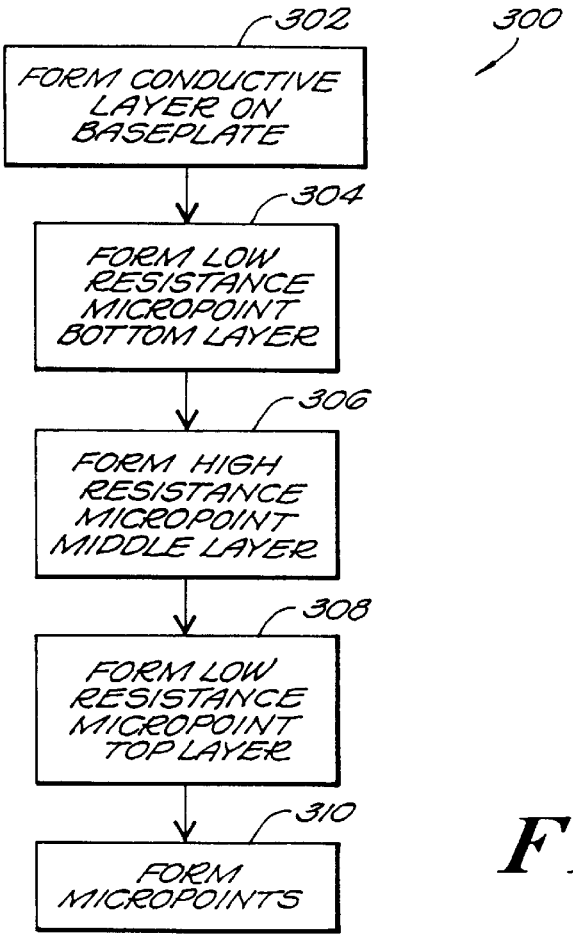
FIG. 3 is a flow chart of a fabrication process for the micropoint assembly in FIG. 2.

Referring to block 302 of FIG. 3, the first step in the fabrication of micropoint assembly 208 is forming conductive layer 206 on baseplate 200. Baseplate 200 can be glass, for example, or any of a variety of other suitable materials such as single crystal, microcrystalline, amorphous or polycrystalline silicon (collectively, the "silicon-based materials"). In a preferred embodiment, this baseplate is made from single crystal silicon that is doped P-type using any suitable process such as diffusion and/or epitaxial growth.

Conductive layer 206, disposed on top of baseplate 200, may be made from any suitable material such as metal or the silicon-based materials. Preferably, this layer is N-type polycrystalline silicon ("polysilicon"). Layer 206 may be formed using any conventional process including epitaxial growth and, preferably, plasma enhanced chemical vapor deposition ("PECVD"). This layer can be doped by any suitable process such as diffusion, implantation, and most preferably, through the addition of dopant gases during deposition (i.e., in situ doping).

Returning to FIG. 3, blocks 304–308 next indicate low, middle and top micropoint layers (i.e., 204*c,* 204*b* and 204*a,* respectively) are successively deposited on top of layer 206. These layers, which may be made from any suitable material, are preferably made from silicon based materials. Moreover, these layers may each be made from the same material or from different materials (e.g., layer 204*c* may be polycrystaline silicon and layer 204*a* may be amorphous silicon). Like layer 206, these layers may be formed, using any conventional process including epitaxial growth and, preferably, PECVD.

Referring to blocks 304 and 308, bottom and top micropoint layers 204*c* and 204*a,* respectively, are low resistance layers. This resistivity level is achieved, preferably, through in situ doping of N-type dopants. Referring to block 306, middle micropoint layer 204*b* is a high resistance layer. This resistivity level is achieved, preferably, through in situ doping of insulating dopants such as oxygen, argon and nitrogen. With respect to layers 204*a*–204*c,* any other suitable doping process may also be used, such as diffusion and ion implantation.

Exemplary N- and P-type dopants for micropoint assembly 208 include phosphorous and boron, respectively. Although assembly 208 is described as preferably having a P-type substrate and N-type micropoints, the reverse is also possible (i.e., N-type substrate and P-type micropoints).

In an alternative embodiment, the high resistivity of micropoint layer 204*b* may be achieved by using undoped silicon-based material, which naturally exhibits a relatively high resistivity. In this instance, the resistivity level will be controlled predominantly by the physical dimensions of the layer, which are preferably sufficiently large to prevent current leakage.

It is well known that single crystal silicon layers are difficult to form on a silicon substrate and even more difficult to form on a glass substrate. However, when formation is successful, this material provides for more uniform and defined conical micropoints (i.e., micropoints with straighter edges and sharper tips) than other silicon-based materials. Alternatively, if ease of formation is of primary concern, amorphous silicon is a preferred material since, for example, forming temperatures are compatible with non-silicon substrate (e.g., glass) processing.

Referring back to FIG. 3, the final step of this fabrication process is forming micropoints pursuant to block 310. There are several methods by which to form micropoint 202 from layers 204*a*–204*c,* including plasma assisted etching and the methods described in U.S. Pat. Nos. 3,970,887 and 5,372,973.

Referring again to FIG. 2, high resistance layer 204*b* may alternatively be formed as the top or bottom layer of the micropoint. If the resistive layer is positioned as bottom layer 204*c,* it is desirable to deposit a layer of semi-insulating polysilicon (SIPOS) on the emitter 206. If the resistive layer is positioned as top layer 204*a,* then underlying layers 204*b* and 204*c* become a single low resistance layer. In micropoint assembly 208, the substrate may be thought of as including one or more of baseplate 200 and layers 206, 204*c,* 204*b,* and 204*a*.

In one embodiment of a field emission display, it may be desirable for the average current flowing into each pixel to be about 1 nA, and for the peak current to be about 500 nA. The peak current is typically significantly larger than the average current because the pixels are typically driven using a raster scan rather than being driven continuously. By way of example, such a field emission display may be arranged so that ten micropoints, such as micropoint 202, are dedicated to controlling the illumination of each pixel. In such an embodiment, the desired resistance of each micropoint is on the order of 2 Giga-Ohms. This resistance would of course be appropriately varied if more or less than ten micropoints were used to control the illumination of a given pixel. In each micropoint 202, most of this resistance is preferably provided by the high resistance layer 204*b* with the resistance of low resistance layers 204*a,* 204*c* being essentially negligable (e.g., from a few tens of Ohms to a few thousands of Ohms). Conventional fabrication techniques may be used to produce high resistance layer 204*b* so that it provides the desired resistance value.

A process and assembly according to a second embodiment of the present invention is illustrated in FIGS. 4A–4D. In contrast to the multi-layer fabrication process and assembly illustrated in FIGS. 2 and 3, the following process involves ion implantation of a single silicon layer.

Figure 4A:
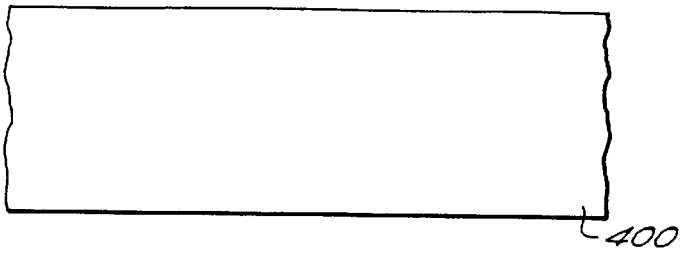
FIGS. 4A–4D are cross-sectional views depicting several of the basic steps employed in manufacturing a micropoint assembly according to a second embodiment of the present invention.

Referring to FIG. 4A, the starting material in this process is preferably a P-type single crystal silicon baseplate 400. Initially, baseplate 400 is masked to define areas for implanting an N-type dopant. These areas, from which one or more micropoints will be formed, may be horizontal strips approximately 10 micrometers wide and 3 micrometers deep, as described in U.S. Pat. No. 3,970,887. The mask may be formed using any conventional masking technique.

Figure 4B:
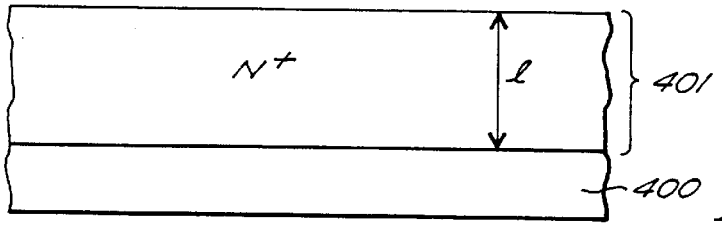

Referring to FIG. 4B, ions are next implanted into baseplate 400 creating one or more N+ doped regions 401 having a predefined depth within the baseplate. The depth ("d") of this region is sufficient to accommodate the height of a micropoint as well as an underlying conductive region.

Figure 4C:
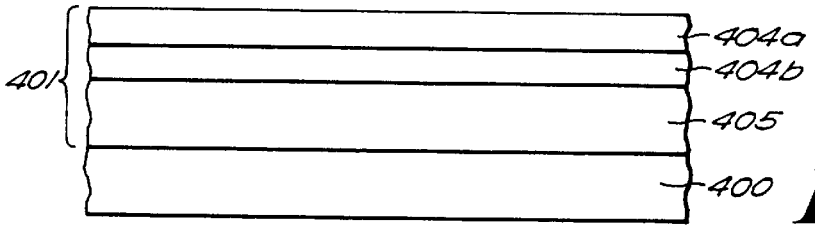

The next step in this process is to implant ions to define a region of high resistivity. Exemplary high-resistivity ions include oxygen, argon and nitrogen. Since this ion implantation step will place ion impurities at a shallower depth than the previous N-type implantation depth, the corresponding implantation energy will be determined accordingly. Referring to FIG. 4C, a high resistivity region 404*b* is shown implanted within N+ region 401. The remaining low resistance regions of 401 are identified as regions 404*a* and 405 which are disposed above and below, respectively, region 404*b*. Region 405 forms part of the resulting micropoints as well as an underlying conductive region, as discussed below.

Figure 4D:
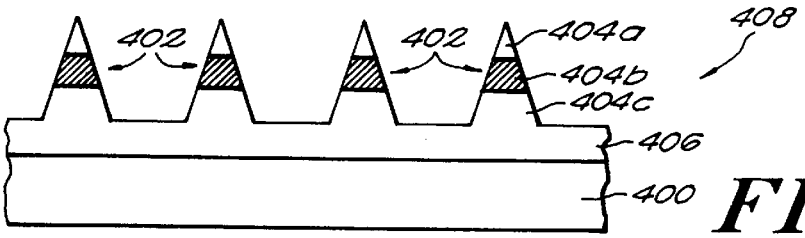

After removing the ion-implantation mask and performing conventional annealing steps (that typically follow ion implantation), micropoints are formed from the layers 405, 404*a* and 404*b*, pursuant to the same methods identified above with respect to micropoint 202 of FIG. 2. Referring to FIG. 4D, micropoints 402 generated from this process are disposed so that a portion of N+ region 405 (i.e., portion 406) resides beneath each micropoint to create a conductive layer. (The other portion of region 405 forms micropoint layer 404*c*.) The resulting micropoint assembly 408 includes one or more micropoints 402 disposed atop a conductive layer 406 which, in turn, covers the remaining P-type portion of baseplate 400.

Referring again to FIG. 4D, each micropoint 402 includes a low resistance top layer 404*a*, a low resistance bottom layer 404*c*, and a high resistance middle layer 404*b*. This middle layer provides sufficient resistance so that the current flowing through the micropoint is limited to a safe level. As described above with respect to micropoint 202 in FIG. 2, the fabrication process of micropoint 402 may be modified to move high resistance middle layer 404*b* to the top or bottom of micropoint structure 402. If the high resistance layer is moved to top layer 404*a*, the underlying low resistance layer is, for example, a single region of uniformly doped N+ type material. The variations in ion implantation energy necessary to move the high resistance layer would be apparent to one having ordinary skill in the art.

Exemplary N- and P-type dopants for micropoint assembly 408 are the same as those described above for assembly 208. Although baseplate 400 is preferably single crystal silicon, this starting material may be any suitable material capable of implantation including the silicon-based materials.

The foregoing in situ doping and ion implantation processes are conventional and well-known to those having ordinary skill in the art. Dopant dosage and resulting concentration to produce functional micropoint emitters is again well-known to those having ordinary skill in the art. The forgoing processes build upon standard micropoint emitter fabrication by adding the steps necessary to incorporate a resistive layer within the micropoint as illustrated in FIGS. 2 and 4D.

A micropoint according to the invention may include low resistance layers doped with phosphors at a concentration of $10^{18}$ per cubic centimeter. An FED containing micropoints constructed according to the invention may substantially prevent the electron current flowing from a micropoint to a phosphor pixel from exceeding approximately $100\mu A/CM^2$ with a voltage across the anode and cathode of 1 to 2 kilovolts (kV). Of course, one having ordinary skill in the art would appreciate that variations may be made upon these parameters to modify resistance levels and thereby alter voltage and current relationships.

As an alternative to the silicon-based baseplate 400 used in micropoint assembly 408 (FIG. 4D), a silicon layer may be placed on top of a non-silicon-based (e.g., glass) baseplate. In this embodiment, compatibility is preferably achieved between the top silicon layer and the underlying glass baseplate. As is well-known in the art, lasers may be employed to heat treat silicon-based materials and thereby orient their crystal structures to achieve compatibility with non-silicon layers such as glass.

Upon successfully orienting a silicon layer and a non-silicon baseplate, the ion implantation process described above may be applied to the silicon layer resulting in silicon-based micropoints disposed atop a silicon-based conductive layer which, in turn, is disposed atop a non-silicon-based baseplate. Using current technology, amorphous and polycrystalline silicon would most easily be oriented with a glass baseplate. (Although single crystal silicon would provide the best performance characteristics, this material is currently more difficult to orient with an underlying glass baseplate.)

A variation of the foregoing embodiments illustrated in FIGS. 2–4D involves a combination of ion implantation of a baseplate and in situ doping of deposited layers. For example, a micropoint assembly can include a conductive layer and a low resistance micropoint bottom layer that are formed from an ion-implanted baseplate (such as, for example, layers 406 and 404*c*, respectively, of assembly 408 in FIG. 4D). This same variation can further include low resistance and high resistance micropoint layers that are formed by deposition and in situ doping (such as, for example, layers 204*b* and 204*a*, respectively, of assembly 208 in FIG. 2). Pursuant to this configuration, a baseplate initially undergoes ion implantation to create a low resistance region that will form part of the resulting micropoints as well as an underlying conductive region. Thereafter, suitable layers (as described above with respect to micropoint assembly 208) are formed to create high resistance and low resistance regions. Finally, micropoints are formed from the resulting combination pursuant to the methods described above (e.g., by plasma assisted etching).

Figure 5A:
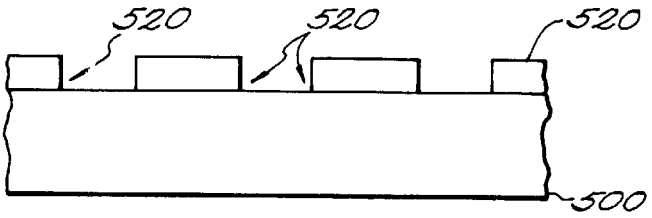
FIGS. 5A–5E are cross-sectional views depicting several of the basic steps employed in manufacturing a micropoint assembly according to a third embodiment of the present invention.

A process and assembly according to a third embodiment of the present invention is illustrated in FIGS. 5A–5E. Referring to FIG. 5A, a mask layer 520 is deposited on a baseplate 500 thereby designating sites, where trenches or troughs in the baseplate are to be formed. The layer 520 can be a photoresist layer or other suitable material known in the art. Preferably, baseplate 500 is an insulating layer (e.g., glass baseplate). However, one having ordinary skill in the art will recognize that there are many other suitable baseplates such as, for example, silicon-based materials, glass and ceramic baseplates.

Figure 5B:
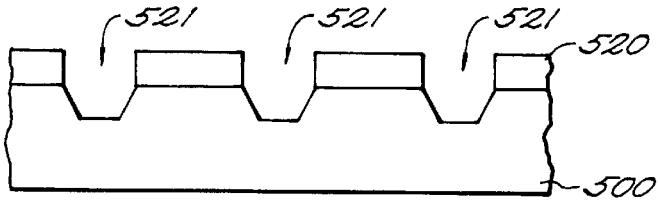

The next step in the process is to etch baseplate 500 at the designated sites thereby forming trenches 521. FIG. 5B illustrates trenches 521 following this etch step. The size of trenches 521 will vary with the size of the corresponding pixel and FED. The trenches 521 may be about $1\mu m$ deep prior to deposition of a conducting layer. Upon completion of this step, masked layer 520 is removed by a conventional process.

Figure 5C:
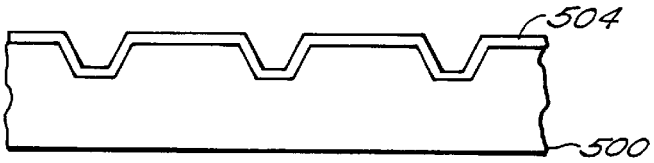

A conformal conductive layer 504 is next deposited in trenches 521 and along the surface of baseplate 500 as illustrated in FIG. 5C. Any suitable conducting material may be used to form conductive layer 504 such as the silicon-based materials. The depth of conductive layer 504 can be in the range of approximately 2000–5000 angstroms. Layer 504 is thereafter planarized (through mechanical action such as, for example, chemical mechanical planarization) back down to the substrate surface level.

Figure 5D:
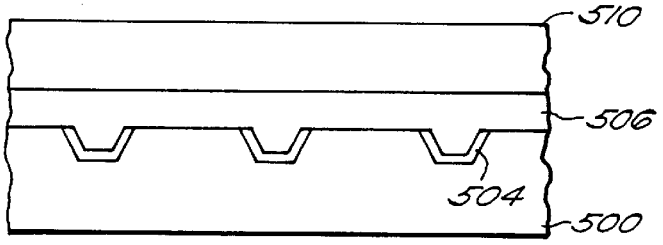

Referring to FIG. 5D, a high resistance layer 506 is formed over planarized conductive layer 504 and the surface of baseplate 500. Layer 506, which may be made from any suitable material (including the silicon-based materials), is preferably made from amorphous silicon. Further, this layer may be formed using any conventional process including PECVD. The high resistivity of layer 506 is preferably achieved through in situ doping of insulating dopants such as oxygen, argon and nitrogen. Next, a low resistance layer 510 (e.g., N+ doped), preferably single crystal silicon, is deposited over layer 506 as shown in FIG. 5D. The combined height of layers 506 and 510 is sufficient for micropoint formation.

Figure 5E:
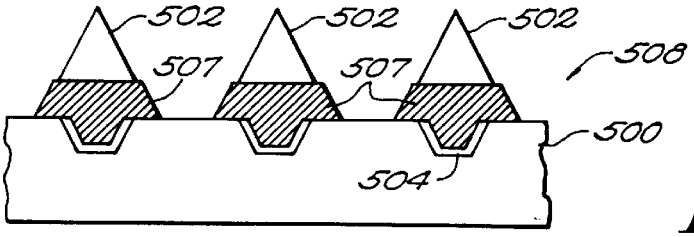

Finally, micropoints are formed from layers 506 and 510 using any known method such as described above with respect to micropoint 202 of FIG. 2. A resulting micropoint assembly 508, as illustrated in FIG. 5E, includes baseplate 500, one or more conductors 504 formed in baseplate 500, a plurality of micropoint-base resistors 507 (formed from layer 506) disposed over conductor 504, and a plurality of micropoint tips 502 disposed over such resistors. Each micropoint-base resistor 507 couples one micropoint tip 502 to conductor 504 to prevent current through micropoint tip 502 from exceeding a maximum level.

In this embodiment, each resistor 507 forms the base of a micropoint over conductor 504. Resistors 507 may also be fabricated by epitaxial growth or ion implantation of, for example, oxygen or argon ions.

Figure 6:
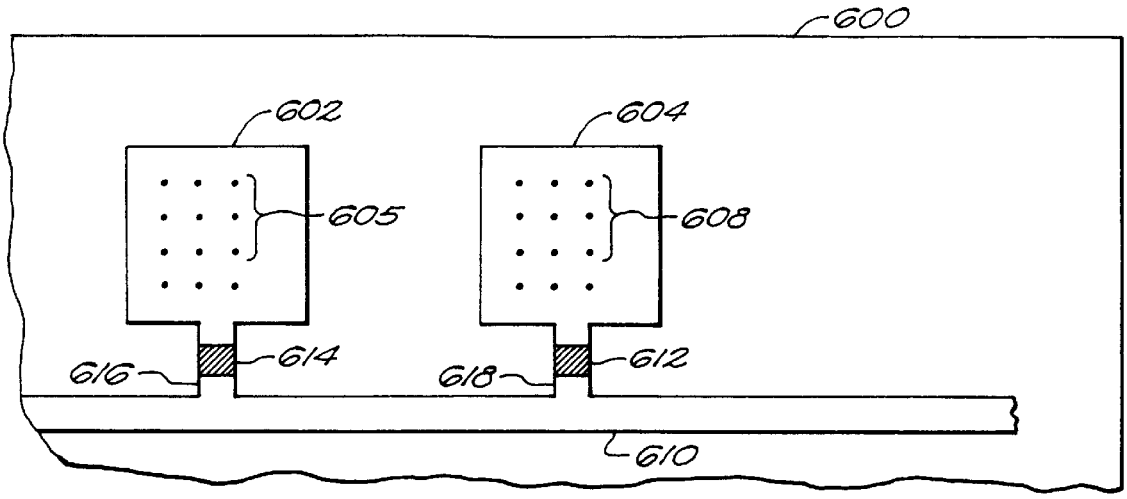
FIG. 6 is a plan view of a portion of a FED according to a fourth embodiment of the present invention.

Referring to FIG. 6, according to another embodiment of the present invention, a number of regions 602, 604, each associated with a particular pixel and having a plurality of micropoints 605, 608, is formed on a baseplate 600. Each region represents a portion of a FED cathode. Rather than providing each individual micropoint with its own resistor, in this embodiment each region 602, 604 is provided with a resistor that limits current through the entire region.

Each region 602, 604 is coupled to a conductor 610 through branch conductors 616 and 618, respectively. These conductors may be formed from any conductive material such as the silicon-based materials. A plurality of resistors 614, 612 (i.e., "conductor-resistors"), are formed within conductors 616 and 618, respectively, by doping these conductors with an insulating-type dopant such as argon or oxygen. Any suitable doping process may be used such as diffusion or ion implantation.

Figure 1:
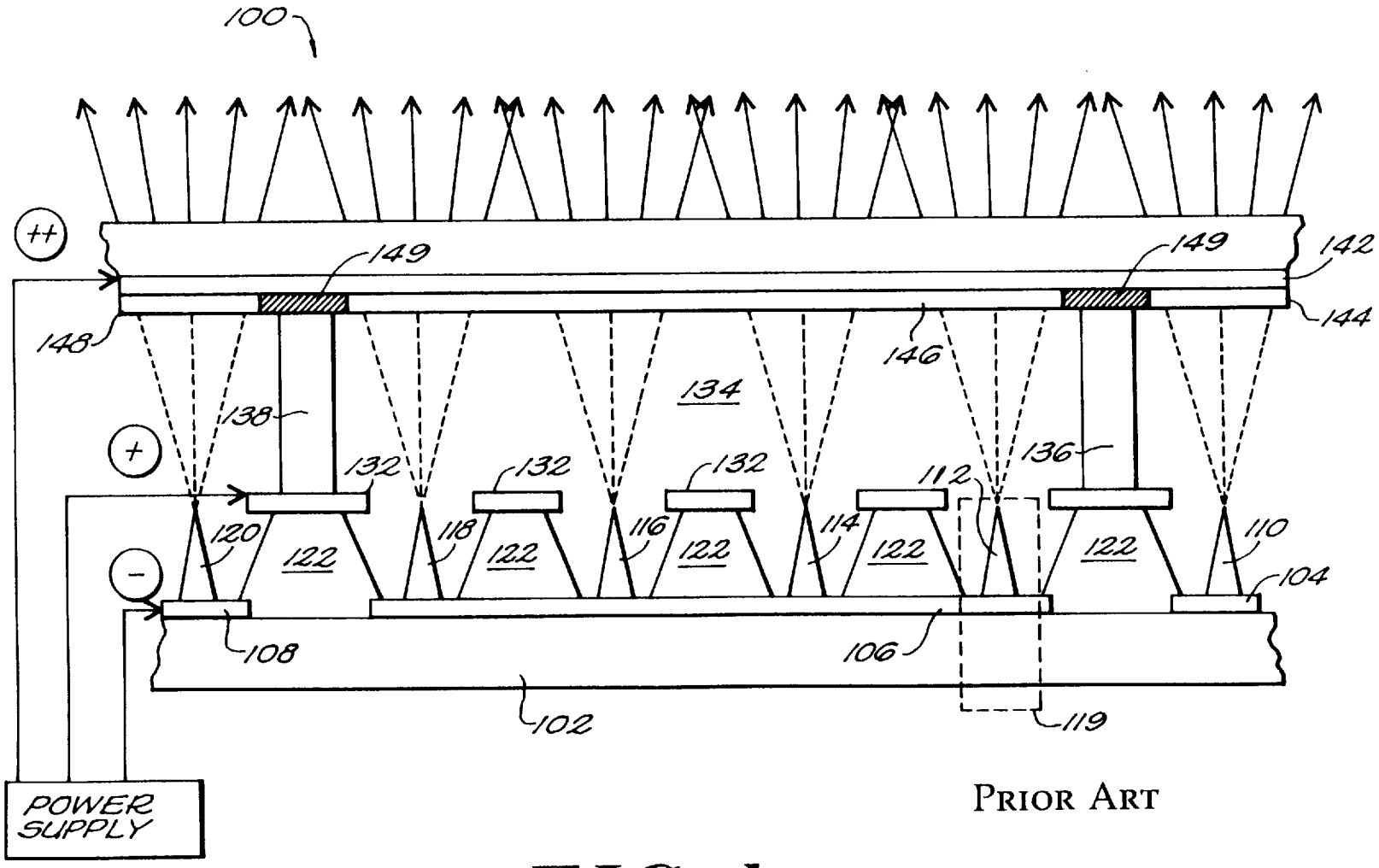
PRIOR ART FIG. 1
FIG. 1 is a cross-sectional view of a FED as is known in the art.

Resistor 614 prevents the current flowing from micropoint region 602 to the faceplate (e.g., faceplate 140 as shown in FIG. 1) from exceeding a desired maximum level, and resistor 612 of course performs the same function for micropoint region 604. For example, if the micropoints in region 602 are all used to control the illumination of a single pixel, resistor 614 may be selected to prevent the current flowing from region 602 to that pixel from exceeding a 500 nA peak current. By way of example, if the voltage difference between a FED anode and baseplate is about 1–2 KV, the resistance provided by resistor 614 may be selected to be about 100 Mega-Ohms. If each of the micropoints in region 602 is provided with its own resistor (e.g., high resistance layer 204*b* as shown in FIG. 2), then the resistance value provided by resistor 614 is preferably varied accordingly.

Fabrication of the micropoints in this embodiment may be carried out through any conventional process such as ion implantation or deposition.

Figure 7A:
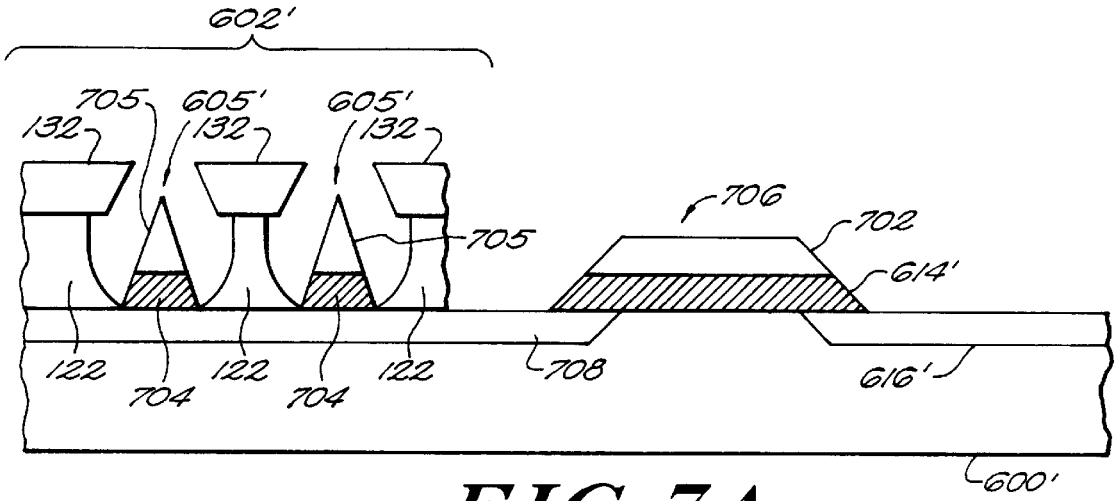
FIG. 7A is a cross-sectional view of a portion of a FED according to a fifth embodiment of the present invention.

FIG. 7A illustrates another embodiment of the present invention incorporating modified conductor-resistors of FIG. 6 with simplified micropoint-base resistors of FIG. 5E. Referring to FIG. 7A, region 602' includes a plurality of micropoints 605' formed on a baseplate 600'. Like the embodiment in FIG. 6, region 602' is associated with a particular pixel and therefore many such regions may exist within a given FED.

Each micropoint 605' within a given region includes a low resistance micropoint tip 705 and high resistance micropoint-base resistor 704. These micropoints are disposed atop a conductive layer 708. Micropoints 605' may be constructed in accordance with the same process described in connection with FIGS. 5A–5E with the exception that troughs are not necessarily formed within baseplate 600'. Conductive layer 708 may be disposed within or placed upon baseplate 600' in accordance with any conventional fabrication process.

Region 602' is coupled to conductor 616' through a conductor-resistor element 706. This element includes a low resistance portion 702 and high resistance portion 614'. Element 706 is constructed simultaneously with micropoint 605' (i.e., using the same layer-formation processes so that high resistance layer 614' is formed from the same layer used to form micropoint base resistors 704 and low resistance layer 702 is formed from the same layer used to form the low resistance micropoint tips 705) resulting in high resistance and low resistance regions that are etched from the same high resistance and low-resistance layers. Use of the same layer formation process provides a high degree of control over the formation of high resistance layer 614' and micropoint base resistors 704 so that these structures may be formed reliably and so that the resistive values actually provided by these structures are within a very small tolerance of resistive values selected for these structures. As shown in FIG. 7A, element 706 facilitates the interconnectivity between conductor 616' and 708.

High resistance portion 614' and micropoint-base resistors 704 combinatorily prevent current from exceeding a maximum level within each micropoint 605'. This helps avoid electrical damage to the micropoints. The resistance of each micropoint-base resistor is in the range of a few gigaohms while the resistance value of portion 614' is determined from pixel current requirements. For example, in a specific embodiment, the voltage difference between a FED anode and baseplate is about 1–2 kV and the maximum allowable current through a micropoint 605' in a region 602' (containing approximately 20 micropoints) is about 25 nA, peak current. Therefore, conductor resistor 614' is preferably selected to have a resistance of about 100 mega-ohms.

Figure 7B:
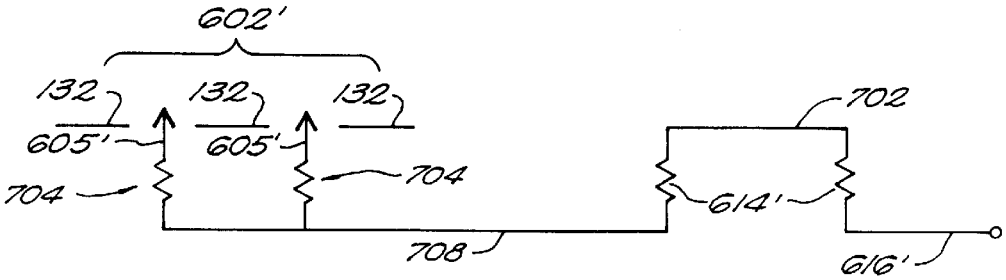
FIG. 7B is an electrical schematic of the embodiment of FIG. 7A.

FIG. 7B illustrates an electrical schematic corresponding to the structure of FIG. 7A. In brief, conductive layer 616' is coupled to an electron source (not shown). Current traversing region 602' is initially limited by resistors 614' and thereafter limited by resistors 704 at each micropoint 605'. Although not shown in FIGS. 7A and 7B, conductive layer 616' is coupled to a conductor 610 in the same way as shown in FIG. 6.

It is to be understood that the above description is intended to be illustrative and not restrictive. Many variations to the above-described method and structure will be readily apparent to those having ordinary skill in the art. For example, this process may incorporate patterned resistors enabling horizontal (rather than purely vertical) interconnections between micropoints and a conductor. The scope of the invention should, therefore, be determined not with reference to the above description but, instead, should be determined with reference to the appended claims, along with their full scope of equivalence.

What is claimed is:

1. A micropoint assembly comprising:

a baseplate;

a conductive layer formed on said baseplate; and a plurality of micropoints disposed over said conductive layer, each of said micropoints including:

a first layer, disposed over said conductive layer, said first layer having a first resistance value; and a base resistor, disposed over said first layer, said base resistor having a second resistance value greater than said first resistance value, all of said base resistors being formed from a common layer of resistive material.

2. The micropoint assembly of claim 1, each of said micropoints further comprising a third layer, disposed over said base resistor said third layer having a third resistance value lower than said second resistance value.

3. The micropoint assembly of claim 1 wherein said baseplate comprises a silicon structure.

4. The micropoint assembly of claim 3 wherein said baseplate comprises a glass layer upon which said silicon structure is disposed.

5. The micropoint assembly of claim 1 wherein said base resistors include a dopant selected from the group consisting of nitrogen and oxygen.

6. A field emission display comprising:

a baseplate;

a plurality of micropoints, each of said micropoints including a micropoint-base resistor disposed over said baseplate and a conductive tip disposed over said resistor, all of said micropoint-base resistors being formed from a common layer of resistive material;

a first conductor coupled to each of said micropoint-base resistors;

a second conductor; and an additional resistor coupled between said first and second conductors, said additional resistor also being formed from said common layer.

7. A field emission display according to claim 6, further comprising a third conductor coupled to said additional resistor.

8. A field emission display according to claim 7, wherein said first conductor is connected to a first portion of said additional resistor, said second conductor is connected to a second portion of said additional resistor, and said third conductor is connected to a third portion of said additional resistor.

9. A field emission display according to claim 8, wherein said first and third conductors are formed from a common layer of conductive material.

10. A field emission display according to claim 6, wherein said micropoint-base resistors include a dopant selected from the group consisting of nitrogen and argon.

* * * * *